US007567036B2

(12) United States Patent
Hirota et al.

(10) Patent No.: US 7,567,036 B2
(45) **Date of Patent: *Jul. 28, 2009**

(54) PLASMA DISPLAY PANEL WITH SINGLE CRYSTAL MAGNESIUM OXIDE LAYER

(75) Inventors: Atsushi Hirota, Yamanashi-ken (JP); Lin Hai, Yamanashi-ken (JP); Taro Naoi, Yamanashi-ken (JP); Takeshi Sasaki, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/082,945

(22) Filed: Mar. 18, 2005

(65) Prior Publication Data

US 2005/0206318 A1 Sep. 22, 2005

(30) Foreign Application Priority Data

| | | |
|---|---|---|
| Mar. 19, 2004 | (JP) | 2004-081052 |
| Jul. 21, 2004 | (JP) | 2004-212961 |
| Oct. 27, 2004 | (JP) | 2004-312466 |

(51) Int. Cl.
*H01J 17/49* (2006.01)

(52) U.S. Cl. ..... 313/586; 313/582; 313/585

(58) Field of Classification Search ..... 313/582–587
See application file for complete search history.

(56) References Cited

U.S. PATENT DOCUMENTS

| | | | | |
|---|---|---|---|---|
| 6,486,611 | B2 * | 11/2002 | Tokunaga et al. | 315/169.4 |
| 2002/0113552 | A1 * | 8/2002 | Juestel et al. | 313/587 |
| 2004/0056594 | A1 * | 3/2004 | Kotera et al. | 313/582 |
| 2004/0075388 | A1 * | 4/2004 | Miyashita et al. | 313/586 |
| 2005/0082982 | A1 * | 4/2005 | Kim | 313/587 |
| 2006/0055325 | A1 * | 3/2006 | Hirota et al. | 313/587 |
| 2006/0066240 | A1 * | 3/2006 | Ushizawa et al. | 313/586 |

FOREIGN PATENT DOCUMENTS

| | | |
|---|---|---|
| EP | 0 823 722 A2 | 2/1998 |
| EP | 1 298 694 A1 | 4/2003 |
| EP | 1 667 190 A1 | 6/2006 |
| JP | 06-325696 | 11/1994 |
| JP | 07-037510 | 2/1995 |

(Continued)

OTHER PUBLICATIONS

Kalder et al., "Short-Wave Luminance Of MgO Crystals", Zhurnal Prikladnoi Spektroskopii, vol. 25, No. 4, pp. 1250-1255, Oct. 1976.*

(Continued)

*Primary Examiner*—Nimeshkumar D Patel
*Assistant Examiner*—Anne M Hines
(74) *Attorney, Agent, or Firm*—Arent Fox LLP

(57) ABSTRACT

A crystalline MgO layer is provided in a position facing a discharge cell formed in a discharge space between the front and back substrates. The crystalline MgO layer includes magnesium oxide crystals caused to emit ultraviolet light with a peak wavelength of between 230 nm and 250 nm by the action of ultraviolet light emitted from xenon in a discharge gas. A phosphor layer emits visible light by being excited by the ultraviolet light emitted from the magnesium oxide layer and the ultraviolet light emitted from the discharge gas.

11 Claims, 11 Drawing Sheets

EMBODIMENT

FOREIGN PATENT DOCUMENTS

| | | |
|---|---|---|
| JP | 07-192630 | 7/1995 |
| JP | 07-296718 | 11/1995 |
| JP | 08-287823 | 11/1996 |
| JP | 09-167566 | 6/1997 |
| JP | 10-233157 | 9/1998 |
| JP | 2001-076629 | 3/2001 |
| JP | 2002-033053 | 1/2002 |
| JP | 2003-031130 | 1/2003 |

OTHER PUBLICATIONS

A. Nishida, et al., "Preparation and Properties of Magnesia Powder by Vapor Phase Oxidation Process", (Zairyou Materials), Nov. 1987, pp. 1157-1161, vol. 36, No. 410, Journal of The Society of Materials Science Japan.

* cited by examiner

EMBODIMENT

SECTION V-V

SECTION W-W

SINGLE CRYSTAL OF
CUBIC SINGLE-CRYSTAL STRUCTURE

SINGLE CRYSTALLINE MgO OF
CUBIC POLYCRYSTAL STRUCTURE

PLASMA DISPLAY PANEL WITH SINGLE CRYSTAL MAGNESIUM OXIDE LAYER

BACKGROUND OF THE INVENTION

1. Field of the Invention

This invention relates to a structure of plasma display panels.

The present application claims priority from Japanese Application No. 2004-312466, the disclosure of which is incorporated herein by reference.

2. Description of the Related Art

A surface-discharge-type alternating-current plasma display panel (hereinafter referred to as "PDP") has two opposing glass substrates placed on both sides of a discharge-gas-filled discharge space. One of the two glass substrates has row electrode pairs extending in the row direction and regularly arranged in the column direction. The other glass substrate has column electrodes extending in the column direction and regularly arranged in the row direction. Unit light emission areas (discharge cells) are formed in matrix form in positions corresponding to intersections between the row electrode pairs and the column electrodes in the discharge space.

The PDP further has a dielectric layer covering the row electrodes and/or the column electrodes. A magnesium oxide (MgO) film is evaporated onto a position of the dielectric layer facing each of the unit light emission areas. The MgO film has the function of protecting the dielectric layer and the function of emitting secondary electrons into the unit light emission area.

A simple and convenient method of forming the MgO film in the manufacturing process for the PDPs is to use a screen printing technique of applying a coating of a paste in which MgO powder is mixed to the dielectric layer to form an MgO film. Consequently, this technique has been considered for adoption as described in Japanese Patent Laid-open Application No. 6-325696, for example.

As described here in the related art, screen printing is used to apply a coating of a paste mixed with a polycrystalline floccules type magnesium oxide obtained by heat-treating and purifying magnesium hydroxide to form a magnesium oxide film for a PDP. In this case, however, the discharge characteristics of the PDP are merely of an extent equal to or slightly greater than that of a PDP having a magnesium oxide film formed by the use of evaporation technique.

An urged need arising from this is to form a magnesium oxide film (i.e. a protective film) capable of yielding a greater improvement in the discharge characteristics of the PDP.

SUMMARY OF THE INVENTION

An object of the present invention is to solve the problem associated with conventional PDPs having a magnesium oxide film formed as described above.

Therefore, a plasma display panel according to the present invention has a front substrate and a back substrate which are opposed to each other on both sides of a discharge space and between which are provided phosphor layers, a plurality of row electrode pairs, and a plurality of column electrodes extending in a direction at right angles to the row electrode pairs to form unit light emission areas in the discharge space in positions corresponding to intersections with the row electrode pairs, the discharge space being filled with a discharge gas. The plasma display panel is characterized by a magnesium oxide layer that is provided in at least a position facing the unit light emission area between the front and back substrates and includes magnesium oxide crystals emitting ultraviolet light with a peak wavelength of between 230 nm and 250 nm upon excitation by ultraviolet light emitted from the discharge gas, in which the phosphor layer emits visible light by being excited by the ultraviolet light emitted from the magnesium oxide layer and the ultraviolet light emitted from the discharge gas.

For the PDP according to the present invention, a best mode for carrying out the present invention is a PDP having a front glass substrate and a back glass substrate between which are provided phosphor layers, row electrode pairs extending in a row direction, and column electrodes extending in a column direction to form discharge cells (unit light emission areas) in the discharge space in positions corresponding to intersections with the row electrode pairs, and further including a crystalline magnesium oxide layer that is formed in a position facing each of the discharge cells by the use of screen printing, offset printing, dispenser techniques, roll-coating techniques or the like to apply a coating of a paste including magnesium oxide crystals on each of discharge-cell-facing portions of a dielectric layer covering the row electrode pairs, or alternatively by the sue of spraying techniques, electrostatic spraying techniques or the like to cause a deposition of magnesium oxide crystal powder on the discharge-cell-facing portion of the dielectric layer for buildup of a powder layer, so that by producing discharge between the row electrode and the column electrode in the discharge cell, ultraviolet light is emitted from xenon included in the discharge gas filling the discharge space and excites the crystalline magnesium oxide layer to cause it to emit ultraviolet light with a peak wavelength of between 230 nm and 250 nm.

In the PDP in the best mode, the crystalline structure of the vapor-phase MgO has a characteristic feature that causes a cathode luminescence (CL) emission having a peak within a wavelength range of 200 nm to 300 nm. This is because the MgO single crystal has an enemy level corresponding to a peak wavelength, so that the energy level enables trapping of electrons for a relatively long time, and the trapped electrons are extracted by an electric field so as to serve as the primary electrons required for initiating a discharge. This makes it possible to offer improvements to the discharge characteristics of the PDP such as a discharge delay to offer optimum discharge characteristics.

Further, the phosphor layer emits visible light by being excited by the ultraviolet light that is emitted from the xenon included in the discharge gas upon the production of discharge in the discharge cell. The phosphor layer emits visible light by being also excited by the ultraviolet light with a peak wavelength ranging from 230 nm to 250 nm which is emitted from the crystalline magnesium oxide layer due to the action of the ultraviolet light emitted from the xenon. As a result, the image brightness is increased.

Still further, the efficiency of excitation by the ultraviolet light with a peak wavelength of between 230 nm and 25 nm, which is emitted from the crystalline magnesium oxide layer, is hardly decreased even when a BAM blue phosphor material is deteriorated by vacuum ultraviolet light emitted from the xenon. Hence, the light emission efficiency of the blue phosphor layer is retained to make the display of a high-brightness image possible at all times.

These and other objects and features of the present invention will become more apparent from the following detailed description with reference to the accompanying drawings.

DETAILED DESCRIPTION OF THE PREFERRED EMBODIMENT

Figure 1:
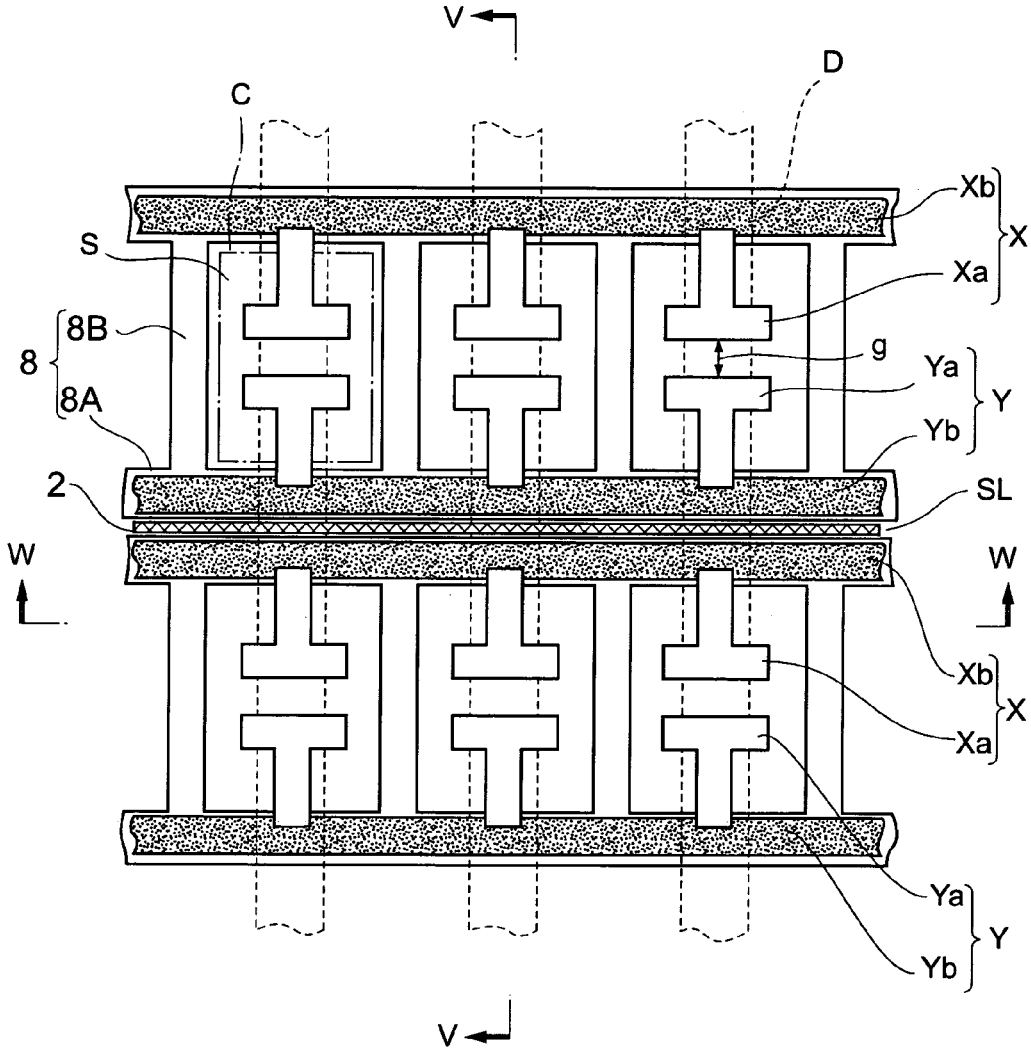
FIG. 1 is a front view illustrating an embodiment of the present invention.
Figure 2:
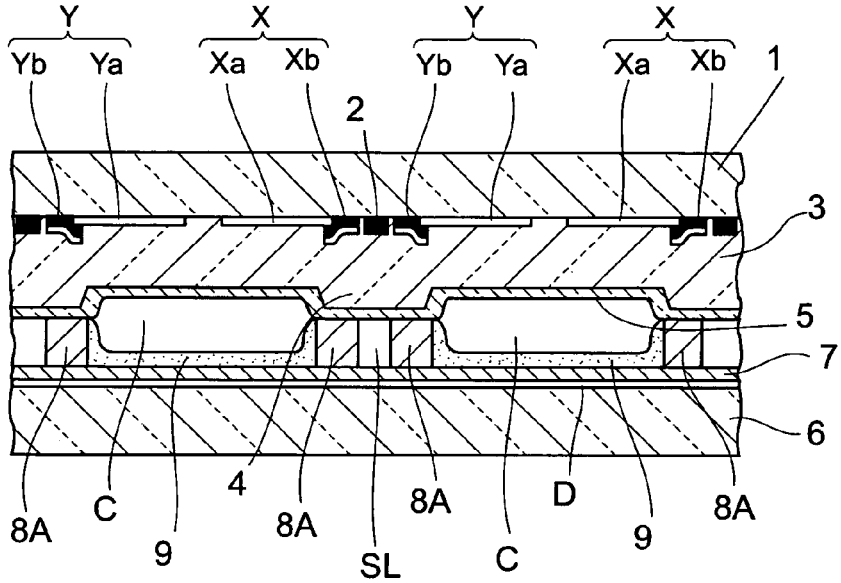
FIG. 2 is a sectional view taken along the V-V line in FIG. 1.
Figure 3:
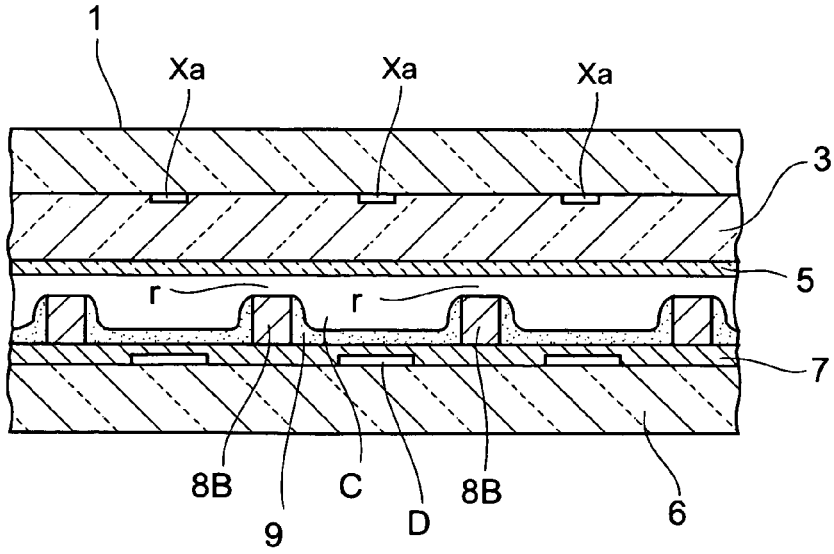
FIG. 3 is a sectional view taken along the W-W line in FIG. 1.

FIGS. 1 to 3 illustrate an embodiment of a PDP according to the present invention. FIG. 1 is a schematic front view of the PDP in the embodiment. FIG. 2 is a sectional view taken along the V-V line in FIG. 1. FIG. 3 is a sectional view taken along the W-W line in FIG. 1.

The PDP in FIGS. 1 to 3 has a plurality of row electrode pairs (X, Y) extending and arranged in parallel on the rear-facing face of a front glass substrate 1 serving as a display surface in a row direction of the front glass substrate 1 (the right-left direction in FIG. 1).

A row electrode X is composed of T-shaped transparent electrodes Xa formed of a transparent conductive film made of ITO or the like, and a bus electrode Xb formed of a metal film. The bus electrode Xb extends in the row direction of the front glass substrate 1. A narrow proximal end (corresponding to the foot of the "T") of each transparent electrode Xa is connected to the bus electrode Xb.

Likewise, a row electrode Y is composed of T-shaped transparent electrodes Ya formed of a transparent conductive film made of ITO or the like, and a bus electrode Yb formed of a metal film. The bus electrode Yb extends in the row direction of the front glass substrate 1. An arrow proximal end of each transparent electrode Ya is connected to the bus electrode Yb.

The row electrodes X and Y are arranged in alternate positions in a column direction of the front glass substrate 1 (the vertical direction in FIG. 1). In each row electrode pair (X, Y), the transparent electrodes Xa and Ya are regularly spaced along the associated bus electrodes Xb and Yb and each extend out toward its counterpart in the row electrode pair, so that the wide distal ends (corresponding to the head of the "T") of the transparent electrodes Xa and Ya face each other with a discharge gap g having a required width in between.

Black- or dark-colored light absorption layers (light-shield layers) 2 are further formed on the rear-facing face of the front glass substrate 1. Each of the light absorption layers 2 extends in the row direction along and between the back-to-back bus electrodes Xb and Yb of the row electrode pairs (X, Y) adjacent to each other in the column direction.

A dielectric layer 3 is formed on the rear-facing face of the front glass substrate 1 so as to cover the row electrode pairs (X, Y), and has additional dielectric layers 4 projecting from the rear-facing face thereof. Each of the additional dielectric layers 4 extends in parallel to the back-to-back bus electrodes Xb, Yb of the adjacent row electrode pairs (X, Y) in a position opposite to the bus electrodes Xb, Yb and the area between the bus electrodes Xb, Yb.

On the rear-facing faces of the dielectric layer 3 and the additional dielectric layers 4, a magnesium oxide layer (hereinafter referred to as "crystalline MgO layer") 5 is formed and contains magnesium oxide crystals having a cubic crystal structure as described later.

The crystalline MgO layer 5 is formed on the entire faces of the dielectric layer 3 and the additional dielectric layers 4 or a part thereof, for example, the parts facing discharge cells, which will be described later.

The example illustrated in FIGS. 1 to 3 describes the case where the crystalline MgO layer 5 is formed on the entire faces of the dielectric layer 3 and the additional dielectric layers 4.

The front glass substrate 1 is parallel to a back glass substrate 6 on both sides of a discharge space S. Column electrodes D are arranged in parallel at predetermined intervals on the front-facing face of the back glass substrate 6. Each of the column electrodes D extends in a direction at right angles to the row electrode pair (X, Y) (i.e. the column direction) in a position opposite to the paired transparent electrodes Xa and Ya of each row electrode pair (X, Y).

On the front-facing face of the back glass substrate 6, a white column-electrode protective layer (dielectric layer) 7 cover the column electrodes D and in turn partition wall units 8 are formed on the column-electrode protective layer 7.

Each of the partition wall units 8 is formed in a substantial ladder shape of a pair of transverse walls 8A extending in the row direction in the respective positions opposite to the bus electrodes Xb and Yb of each row electrode pair (X, Y), and vertical walls 8B each extending in the column direction between the pair of transverse walls 8 in a mid-position between the adjacent column electrodes D. The partition wall units 8 are regularly arranged in the column direction in such a manner as to form an interstice SL extending in the row direction between the back-to-back transverse walls 8A of the adjacent partition wall sets 8.

The ladder-shaped partition wall units 8 partition the discharge space S between the front glass substrate 1 and the back glass substrate 6 into quadrangles to form discharge cells C in positions each corresponding to the paired transparent electrodes Xa and Ya of each row electrode pair (X, Y).

In each discharge cell C, a phosphor layer 9 covers five faces: the side faces of the transverse walls 8A and the vertical walls 8B of the partition wall unit 8 and the face of the column-electrode protective layer 7. The three primary colors, red, green and blue, are individually applied to the phosphor layers 9 such that the red, green and blue colors in the discharge cells C are arranged in order in the row direction.

The additional dielectric layer 4 provides a block between the discharge cell C and the interstice SL because the crystalline MgO layer 5 covering the surface of the additional dielectric layer 4 (or the additional dielectric layer 4 when the crystalline MgO layer 5 is formed only on a part of the additional dielectric layer 4 facing the discharge cell C) is in contact with the front-facing face of the transverse wall 8A of the partition wall unit (see FIG. 2). However, the crystalline MgO layer 5 is out of contact with the front-facing face of the vertical wall 8B (see FIG. 3) to form a clearance r therebetween, so that the adjacent discharge cells C in the row direction communicate with each other by means of the clearance r.

The discharge space S is filled with a discharge gas including 10 percent by volume or more of xenon.

For the buildup of the crystalline MgO layer 5, a spraying technique, electrostatic spraying technique or the like is used to cause the MgO crystals as described earlier to adhere to the rear-facing faces of the dielectric layer 3 and the additional dielectric layers 4.

The vapor-phase MgO single crystal layer 5 has a crystalline structure that causes a CL emission having a peak within a wavelength range of 200 nm to 300 nm (more particularly, of 230 nm to 250 nm, around 235 nm). Also, the MgO crystals are excited by 142 nm and 172 nm vacuum ultraviolet light which is generated from the xenon by discharge, and thereby emit ultraviolet light with a peak wavelength of between 230 nm and 250 nm. Again, this is because the MgO single crystal 5 has an energy level corresponding to a peak wavelength, so that the energy level enables trapping of electrons for a relatively long time, and the trapped electrons are extracted by an electric field so as to serve as the primary electrons required for initiating a discharge. This makes it possible to offer improvements to the discharge characteristics of the PDP.

The MgO crystal includes a single crystal of magnesium which is obtained, for example, by performing vapor-phase oxidation on magnesium steam generated by heating magnesium (the single crystal of magnesium is hereinafter referred to as "vapor-phase magnesium oxide single-crystal").

Figure 4:
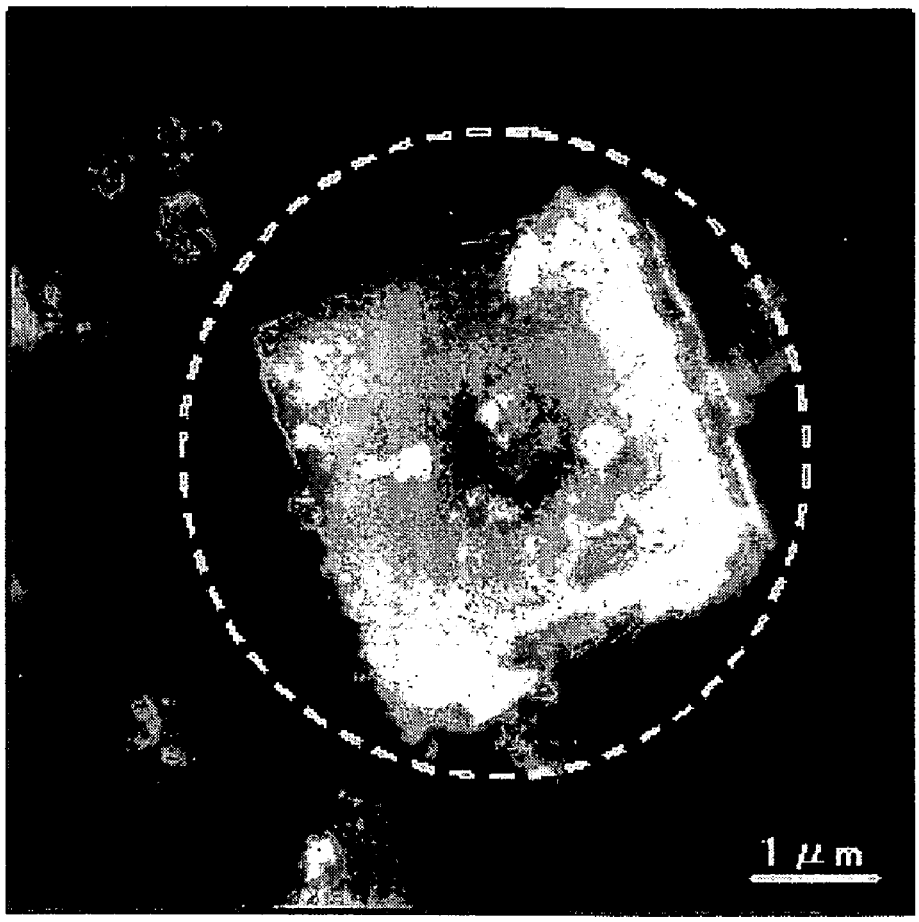
FIG. 4 is a SEM photograph of an MgO single crystal having a cubic single-crystal structure.
Figure 5:
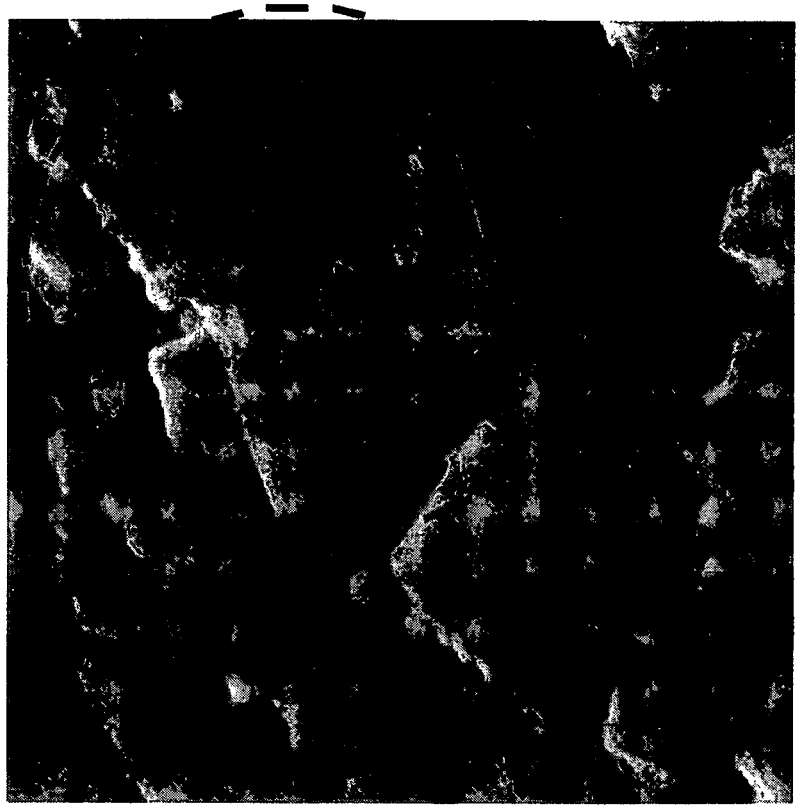
FIG. 5 is a SEM photograph of MgO single crystals having a cubic polycrystal structure.

The vapor-phase magnesium oxide single-crystals include an MgO single crystal having a cubic single crystal structure as illustrated in an SEM photograph in FIG. 4, and an MgO single crystal having a structure of cubic crystals fitted to each other (i.e. a cubic polycrystal structure) as illustrated in a SEM photograph in FIG. 5.

Typically, the MgO single crystal having a cubic single-crystal structure and the MgO single crystal having a cubic polycrystal structure exist together.

The preparation of the vapor-phase magnesium oxide single crystal is described in "Preparation and Properties of Magnesia Powder by Vapor Phase Oxidation Process" ("Zairyou (Materials)" vol. 36, no. 410, pp. 1157-1161, the November 1987 issue), and the like.

The MgO crystals contribute to an improvement in discharge characteristics, such as a reduction in discharge delay time in the PDP, and an enhancement of image brightness, as described later.

As compared with that obtained by another method, the vapor-phase magnesium oxide single crystal has the features of being of a high purity, taking a microscopic particle form, and causing less particle agglomeration.

The vapor-phase magnesium oxide single crystal used in the embodiment has a particle diameter of 500 angstroms or more, preferably 2000 angstroms, in average based on a measurement using a BET method.

Figure 6:
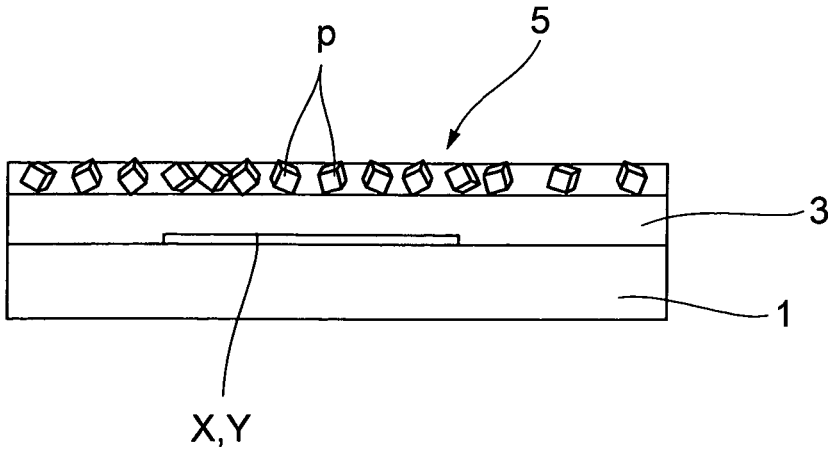
FIG. 6 is a sectional view showing the state of a single-crystalline MgO layer formed by applying a coating of a paste including MgO powder in the embodiment.

FIG. 6 illustrates a structure when a paste including vapor-phase magnesium oxide single crystals p is applied as a coating on the surface of the dielectric layer 3 (and the additional dielectric layer 4) by a method using screen printing, offset printing, dispenser technique, roll-coating technique or the like to form the crystalline MgO layer 5.

Figure 7:
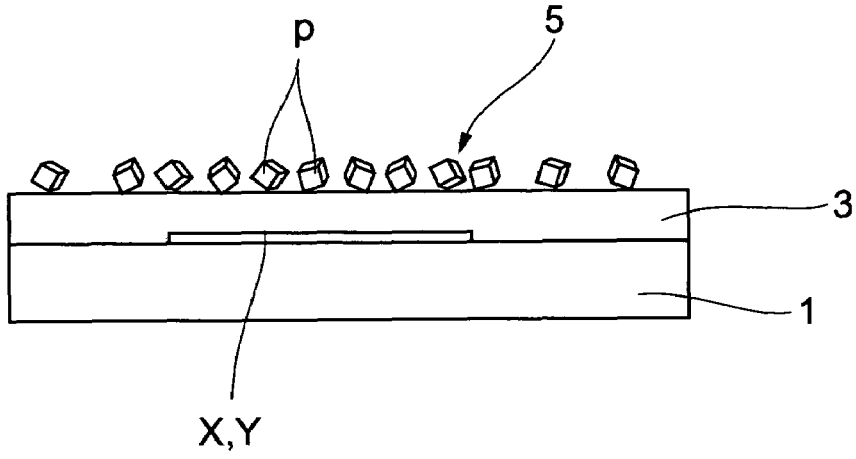
FIG. 7 is a sectional view showing the state of a single-crystalline MgO layer formed of a powder layer resulting from a deposition of an MgO single-crystalline powder in the embodiment.

FIG. 7 illustrates the example of the crystalline MgO layer 5 constituted a powder layer that is formed by using spraying techniques, electrostatic spraying techniques or the like to cause the vapor-phase magnesium oxide single crystals p to adhere to the surface of the dielectric layer 3 (and the additional dielectric layer 4).

In this case, for the buildup of the powder layer an air spraying technique, for example, is used to spray a suspension of the vapor-phase magnesium oxide single crystals p in a medium (e.g. a specified alcohol) on the surface of the dielectric layer 3 (and the additional dielectric layer 4) with a spray gun to allow the deposition of the vapor-phase magnesium oxide single crystals p.

The above is described as an example of the case when only the crystalline MgO layer 5 is formed on the surfaces of the dielectric layer 3 and the additional dielectric layer 4. However, a double layer structure may be adopted, in which, as illustrated in FIG. 8, an evaporated MgO layer 5A is first formed on the surface of the dielectric layer 3 (and the additional dielectric layer 4), and then the vapor-phase magnesium oxide single crystals p are allowed to adhere to the evaporated MgO layer 5A by spraying techniques, electrostatic spraying techniques or the like to form the crystalline MgO layer 5.

Figure 8:
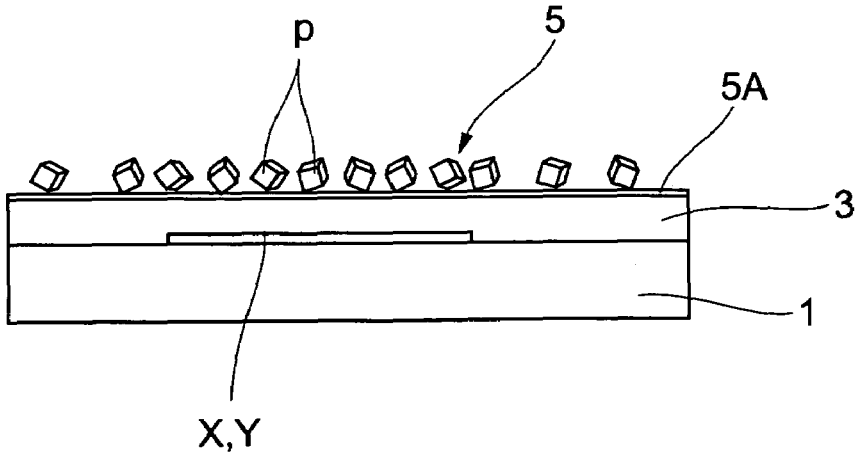
FIG. 8 is a sectional view of a modified example in which a single-crystalline MgO layer is formed on an MgO layer by vapor deposition in the embodiment.

In FIG. 8, further, the positions of the evaporated MgO layer 5A and the crystalline MgO layer 5 may be reversed so that the evaporated MgO layer 5A is formed on the crystalline MgO layer 5.

In the above-mentioned PDP, reset discharge, address discharge and sustaining discharge for generating an image are produced in the discharge cell C.

Specifically, the reset discharge is produced concurrently during the reset period across each of the gaps between the paired transparent electrodes Xa and Ya in the row electrode pairs (X, Y). Thereupon, wall charges on a portion of the dielectric layer 3 adjacent to each discharge cell C are all erased (or alternatively are formed). In the following address period, the address discharge is produced selectively between the transparent electrode Ya of the row electrode Y and the column electrode D. Thereupon, the emission cells in which the wall charges have accumulated on the dielectric layer 3 and the shut-down cells in which the wall charges have been erased from the face of the dielectric layer 3 are distributed over the panel surface in accordance with the image to be displayed. After that, in the following sustaining discharge period, the sustaining discharge is produced between the paired transparent electrodes Xa and Ya of the row electrode pair (X, Y) in each emission cell.

By means of this sustaining discharge, vacuum ultraviolet light at 142 nm wavelength (resonance beam) and 172 nm wavelength (molecular beam) is emitted from the xenon in the discharge gas. The vacuum ultraviolet light excites the red-, green-, and blue-colored phosphor layers 7 to allow them to emit visible light to form the image on the panel surface.

Figure 9:
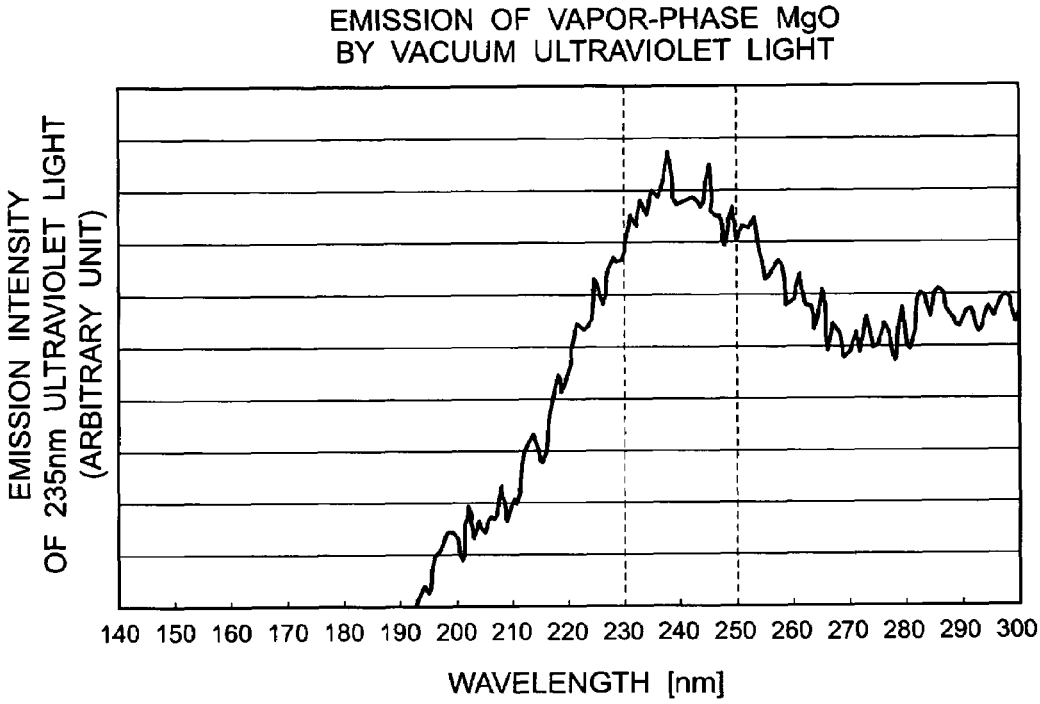
FIG. 9 is a graph showing the intensities of ultraviolet emission of an MgO single crystal.

The vapor-phase MgO single crystal layer 5 has a crystalline structure that causes a CL emission having a peak within a wavelength range of 200 nm to 300 nm (more particularly, of 230 nm to 250 nm, around 235 nm). The MgO crystals are excited also by the vacuum ultraviolet light at 142 nm and 172 nm wavelengths which is generated from the xenon in the discharge gas by the discharge produced in the said discharge cell, to thereby emit ultraviolet light with a peak wavelength of between 230 nm and 250 nm, as shown in FIG. 9. As previously stated, the MgO single crystal 5 has an energy level corresponding to a peak wavelength, so that the energy level enables trapping of electrons for a relatively long time, and the trapped electrons are extracted by an electric field so as to serve as the primary electrons required for initiating a discharge. This makes it possible to offer improvements to the discharge characteristics of the PDP.

Figure 10:
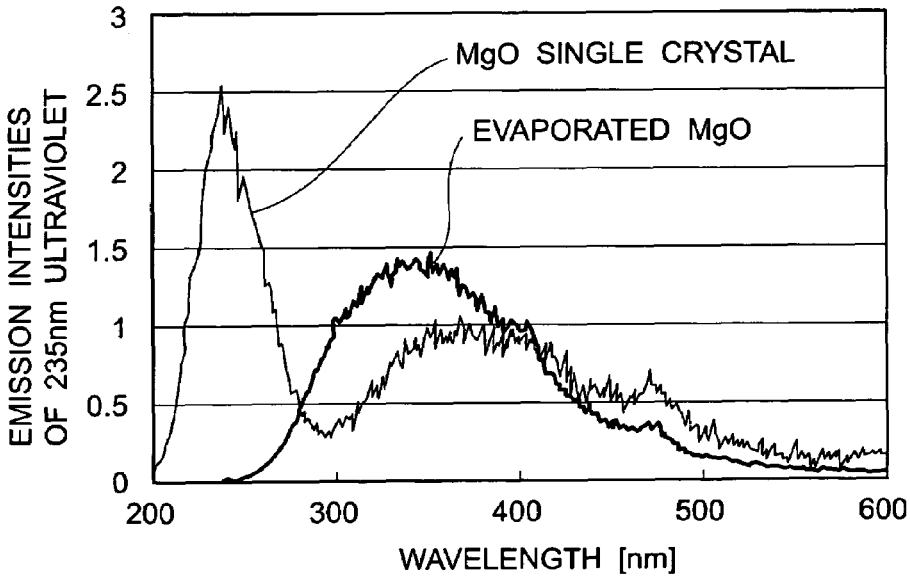
FIG. 10 is a graph showing a comparison between the intensities of ultraviolet emission from an MgO single crystal and evaporated MgO.
Figure 11:
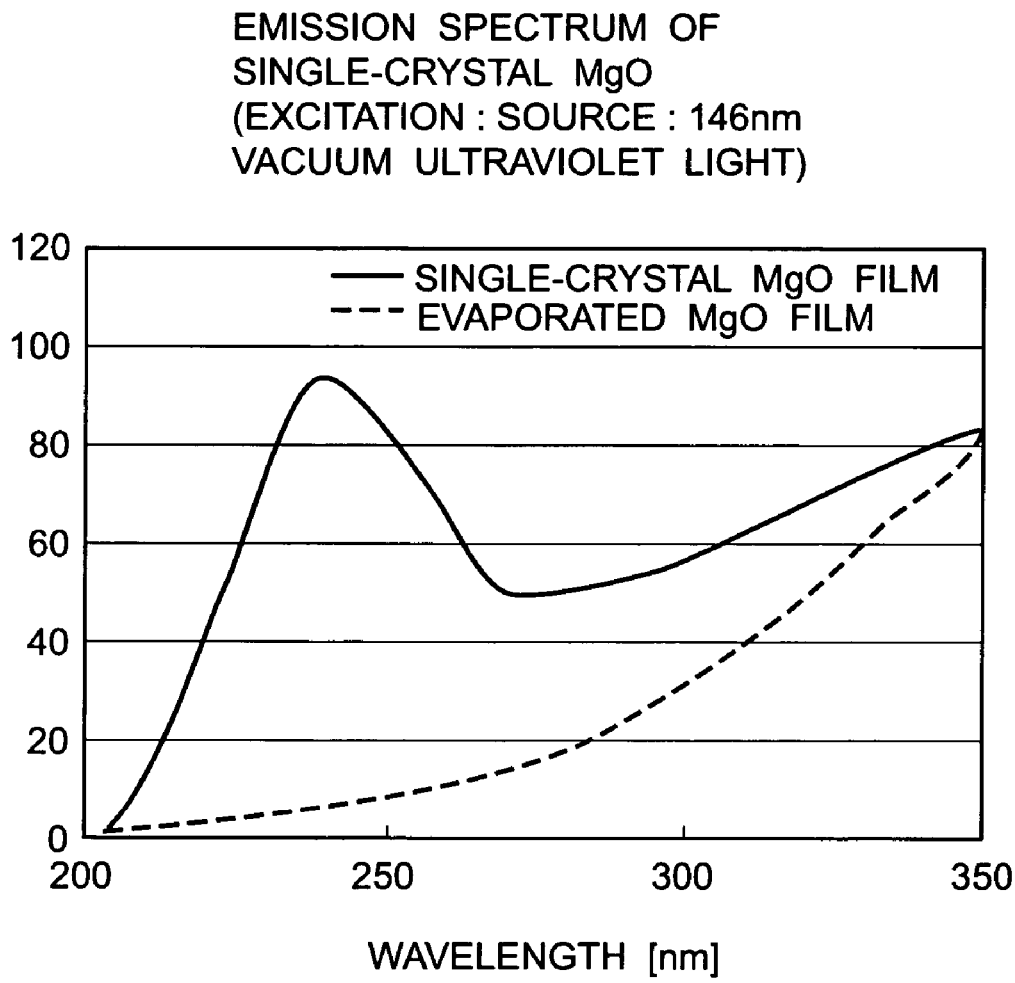
FIG. 11 is a graph showing the emission spectrum of an MgO single crystal.

As seen from FIG. 10 showing the intensities of 235 nm ultraviolet emission and FIG. 11 showing the emission spectrum of single-crystal MgO (vapor-phase magnesium oxide single crystal), ultraviolet light with a peak wavelength of between 230 nm and 250 nm is not emitted from an MgO layer formed by a conventional vapor deposition technique (e.g. the evaporated MgO layer 5A illustrated in FIG. 8).

Figure 12:
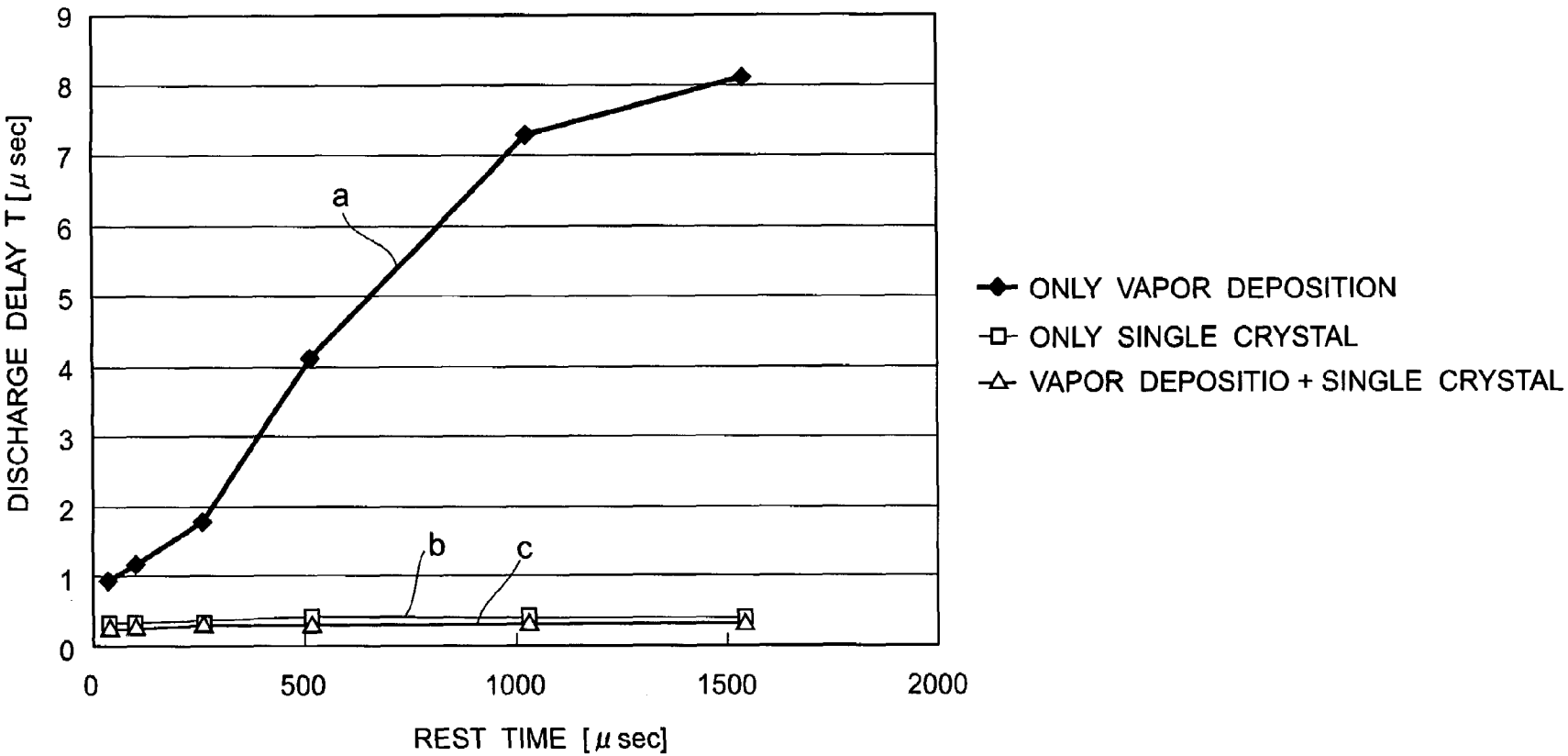
FIG. 12 is a graph showing the state of improvement of the discharge delay in the embodiment.

FIG. 12 shows the comparison of the discharge delay time measured every predetermined rest time in the following cases: (Graph a) when the PDP has only the MgO layer formed by a conventional vapor deposition technique (e.g. the evaporated MgO layer 5A illustrated in FIG. 8); (Graph b) when it has only the crystalline MgO layer 5; and (Graph c) when it has the double layer structure of the MgO layer formed by a conventional vapor deposition technique (e.g. the evaporated MgO layer 5A illustrated in FIG. 8) and the crystalline MgO layer 5.

In FIG. 12, as compared with the case when the PDP has only the MgO layer formed by a conventional vapor deposition technique (Graph a), the discharge delay time is significantly reduced in both the case when it has only the crystalline MgO layer 5 (Graph b) and the case when it has the double layer structure of the MgO layer formed by a conventional vapor deposition technique and the crystalline MgO layer 5 (Graph c).

From this, it is evident that the reduction in the discharge delay time is ascribable to the MgO crystal (specifically, the vapor-phase magnesium oxide single crystal) used for the crystalline MgO layer 5).

The mechanism of the reduction in the discharge delay time by the MgO crystal is estimated as follows.

With regard to the improvement of the discharge characteristics by means of the crystalline MgO layer 5, the vapor phase MgO single crystal, which causes a CL emission with a peak within a wavelength range of 200 nm to 300 nm (more particularly, of 230 nm to 250 nm, around 235 nm), has an energy level corresponding to the peak wavelength. Depending on this energy level, it is possible to trap for a long time (several msecs or more) electrons generated during the reset discharge. The trapped electrons are extracted by an electric field being produced by the application of address voltage. Thus, the initial electrons required for starting the discharge are sufficiently and quickly secured to advance the starting of the discharge. This has been estimated as a possible cause of the reduction in the discharge delay time.

The higher the intensity of CL emission with a peak within a wavelength range of 200 nm to 300 nm (more particularly, of 230 nm to 250 nm, around 235 nm), the greater the effect of the MgO crystal on the improvement of the discharge characteristics.

Figure 13:
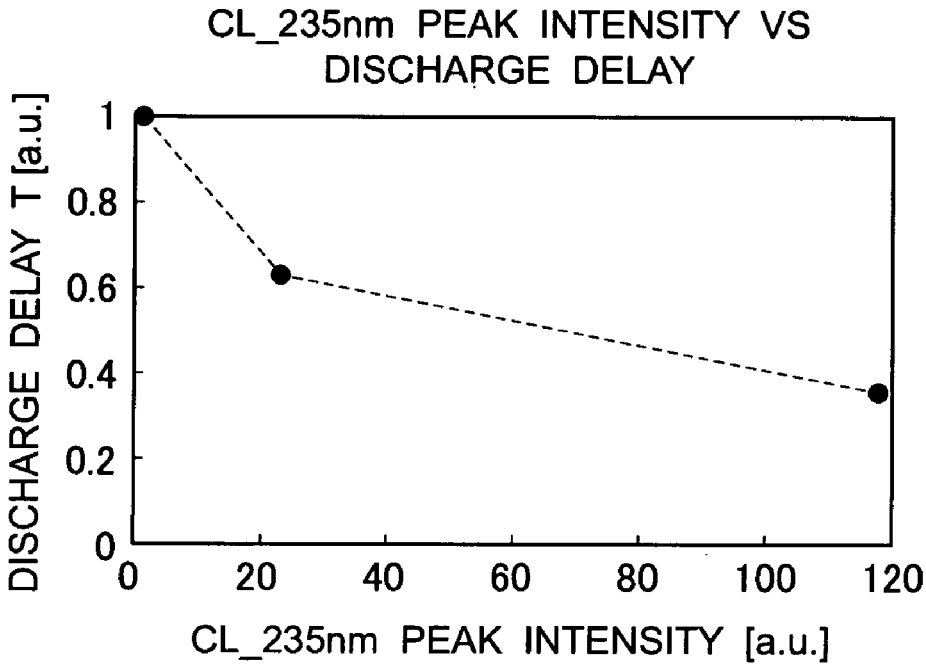
FIG. 13 is a graph showing the relationship between the discharge delay and the peak intensities of CL emission at 235 nm from an MgO single crystal.

FIG. 13 is a graph showing the correlation between the discharge delay and the intensity of CL emission of the MgO crystal.

The data in FIG. 13 is obtained from measurement of the results of directly irradiating the MgO crystals forming the crystalline MgO layer 5 with an electron beam of the order of 1 kV.

It is seen from FIG. 13 that the discharge delay time is reduced as the intensity of the 235 nm CL emission from the excited crystalline MgO layer 5 becomes higher.

The effect of the CL emission of the MgO crystal on the reduction in the display delay time is in correlation with the particle size of the MgO crystal. The larger the particle size of the MgO crystal, the higher the intensity of the CL emission, leading to a reduction in the discharge delay time.

There is a possible reason for this. A necessary factor for producing a vapor phase magnesium oxide single crystal of large particle size, for example, is to increase the heating temperature when magnesium steam is generated. Therefore, the length of flame produced when oxygen reacts with the magnesium increases to increase the temperature difference between the flame and the surrounding air. Thereby, the larger the particle size of the vapor phase magnesium oxide single crystal, the larger the number of energy levels that are created in correspondence with the peak wavelength of the CL emission as described earlier.

In the vapor phase magnesium oxide single crystal of a cubic polycrystal structure, many plane defects occur. The presence of energy levels arising from these plane defects contributes to improvement in discharge characteristics.

As described earlier, vacuum ultraviolet light of 147 nm (resonance beam) and 172 nm (molecular beam) is emitted from the xenon (Xe) in the discharge gas by means of the sustaining discharge. Then, the vacuum ultraviolet light excites the red, green and blue phosphor layers 9 of the PDP to allow them to emit visible light in the individual colors.

At this point, the vacuum ultraviolet light, which is emitted from the xenon (Xe) in the discharge gas by means of the sustaining discharge, causes the emission of ultraviolet light with a peak wavelength within the range from 230 nm to 250 nm from the crystalline MgO layer 5 (see FIGS. 9 to 11).

Figure 14:
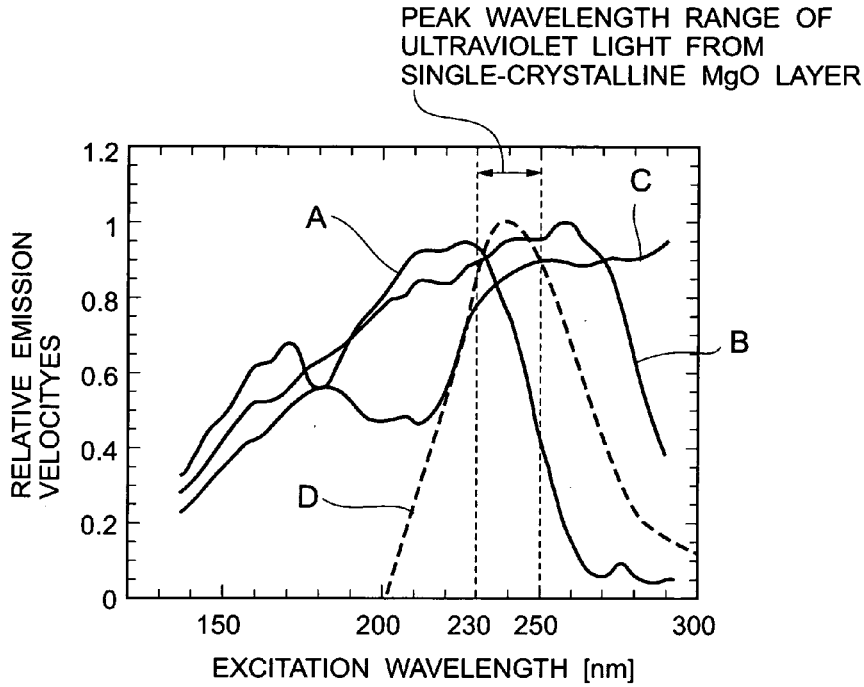
FIG. 14 is a graph showing the relative velocity of emissions from the phosphor layer of each color caused due to the action of ultraviolet light.

As shown in FIG. 14, the ultraviolet light with a peak wavelength of between 230 nm and 250 nm emitted from the single crystalline MgO layer 5 is within an optimum wavelength range to efficiently excite each of the red, green and blue phosphor layers 9 for visible light emission. That is, in addition to the vacuum ultraviolet light emitted from the xenon (Xe) in the discharge gas, the phosphor layer 9 emits visible light by being also excited by the ultraviolet light with a peak wavelength of between 230 nm and 250 nm emitted from the single crystalline MgO layer 5. Because of the added excitation, the image brightness of the PDP is increased.

In FIG. 14, graph A shows the relative velocities of emission of the red phosphor ($(Y, Gd)BO_3:Eu^{3+}$), graph B shows the relative velocities of emission of the green phosphor ($Zn\text{-}SiO_4:Mn^{21}$), and graph C shows the relative velocities of emission of the blue phosphor ($BaMgAl_{10}O_{17}:Eu^{21}$). Further, graph D shows the emission characteristics of an MgO single crystal.

Figure 15:
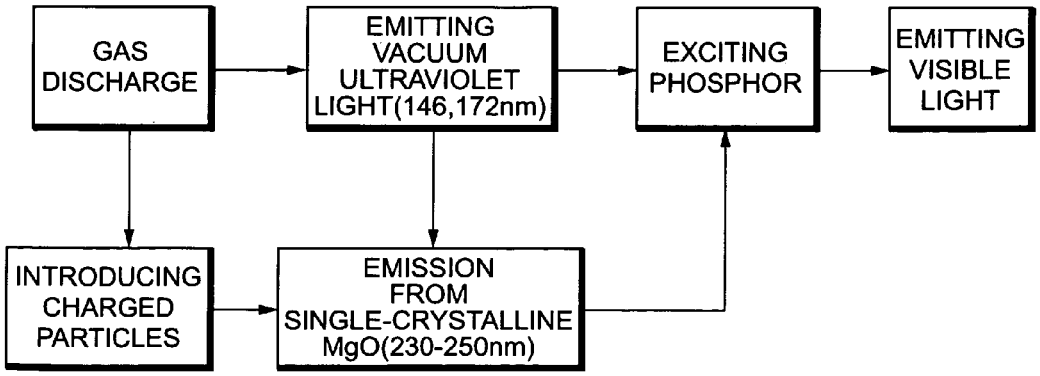
FIG. 15 is a diagram illustrating a system of inducing visible-light emission from the phosphor layer in the embodiment.

FIG. 15 describes the system of inducing visible-light emission from the phosphor layer. It is understood from FIG. 15 that the amount of emission from the phosphor layer 9 is increased to increase the brightness of the PDP by providing in the PDP a crystalline MgO layer 5 emitting ultraviolet light with a peak wavelength of between 230 nm to 25 nm, as compared with a conventional case where the phosphor layer 9 emits visible light by being excited only by the vacuum ultraviolet light emitted from the xenon (Xe) in the discharge gas.

Figure 16:
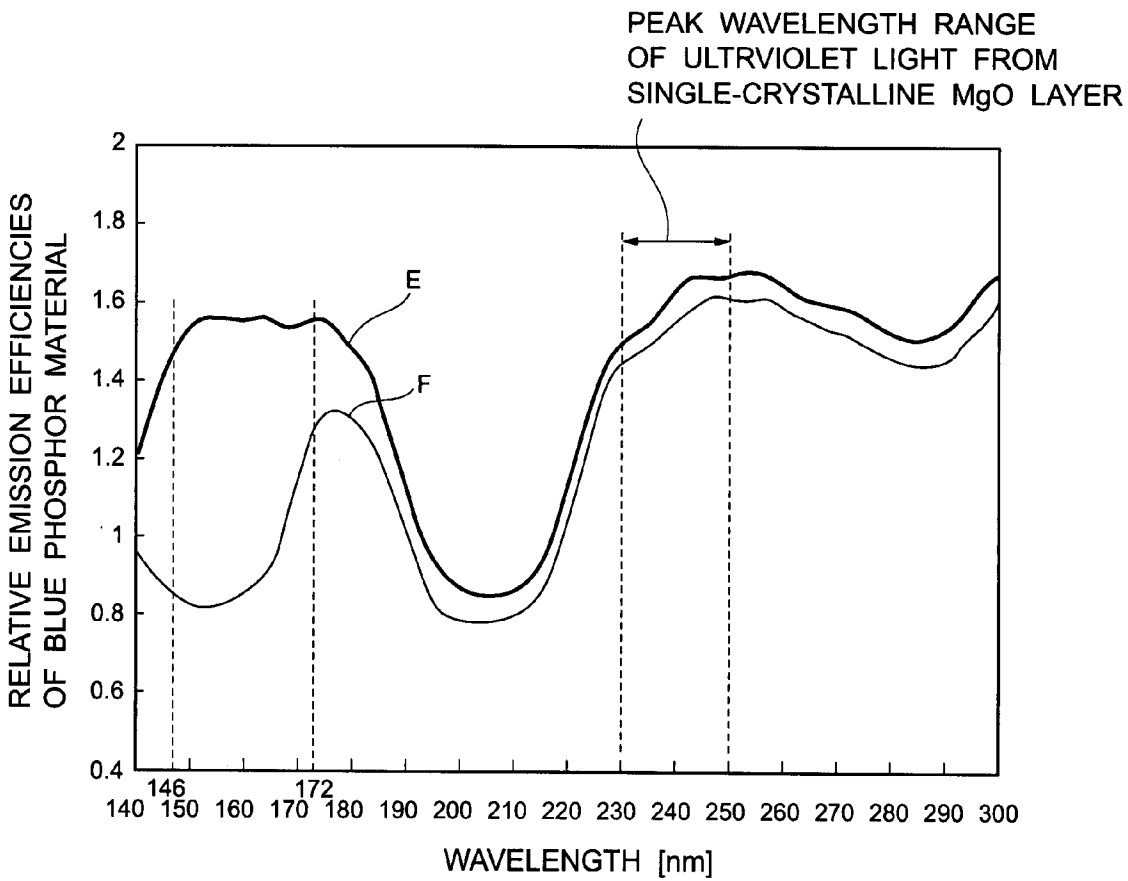
FIG. 16 is a graph showing the relative efficiency of emission from the blue phosphor layer.

FIG. 16 is a graph showing the relationship between excitation wavelengths and relative emission efficiencies of ultraviolet light when the blue phosphor layer 9 is formed of BAM blue phosphor material.

In FIG. 16, graph E shows the relative emission efficiencies of the BAM blue phosphor material at the time of starting ultraviolet irradiation. Graph F shows the relative emission efficiencies of the BAM blue phosphor material after the completion of the ultraviolet irradiation over a predetermined time period.

As is seen from FIG. 16, in the irradiation with the vacuum ultraviolet light of 146 nm and 172 nm emitted from the xenon (Xe) included in the discharge gas, he BAM blue phosphor material is deteriorated by the radiation of vacuum ultraviolet from xenon to reduce the emission efficiency. However, in the irradiation with the ultraviolet light of 230 nm to 25 nm wavelengths emitted from the crystalline MgO layer 5, even when the BAM blue phosphor material is deteriorated by the radiation of vacuum ultraviolet from the xenon, the emission efficiency of the BAM blue phosphor material is less reduced.

Thus, the PDP is capable of displaying an image with high brightness at all times because providing the crystalline MgO layer 5 leads to maintaining the emission efficiency of the blue phosphor layer 9.

The crystalline MgO layer 5 is not necessarily required to cover the entire face of the thin-film MgO layer 5A as described earlier. The crystalline MgO layer 5 may be partially formed by patterning in a position facing the transparent electrodes Xa, Ya of the row electrodes X, Y or a position facing any area other than the transparent electrodes Xa, Ya, for example.

The foregoing has described the example when the present invention applies to a reflection-type AC PDP having row electrode pairs formed on the front glass substrate and covered with a dielectric layer, and having column electrodes and phosphor layers formed on the back glass substrate. However, the present invention is applicable to various types of PDPs, for example, a reflection-type AC PDP having row electrode pairs and column electrodes formed on the front glass substrate and covered with a dielectric layer, and having phosphor layers formed on the back glass substrate; a transmission-type AC PDP having phosphor layers formed on the front glass substrate, and row electrode pairs and column electrodes formed on the back glass substrate and covered with a dielectric layer; a three-electrode AC PDP having discharge cells formed in the discharge space in positions corresponding to the intersections between row electrode pairs and column electrodes; a two-electrode AC PDP having discharge cells formed in the discharge space in positions corresponding to the intersections between row electrode pairs and column electrodes.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel having a front substrate and a back substrate which are opposed to each other on both sides of a discharge space and between which are provided phosphor layers, a plurality of row electrode pairs, and a plurality of column electrodes extending in a direction at right angles to the row electrode pairs to form unit light emission areas in the discharge space in positions corresponding to intersections with the row electrode pairs, the discharge space being filled with a discharge gas, comprising:

a magnesium oxide layer disposed in at least a position facing each of the unit light emission areas between the front and back substrates and which includes magnesium oxide crystals that emit ultraviolet light with a peak wavelength of 230 nm to 250 nm upon being excited by an ultraviolet light, wherein the magnesium oxide crystals have a cubic single crystal structure and a structure of cubic crystals fitted to each other, and a crystalline structure of the magnesium oxide crystals cause a cathode luminescence emission having a peak within a wavelength range of 200 nm to 300 nm.

2. A plasma display panel according to claim 1, wherein the discharge gas includes xenon, and the magnesium oxide crystals are excited by the ultraviolet light that is emitted from the xenon by discharge produced in the discharge gas, and emit the ultraviolet light with principal wavelengths of 230 nm to 250 nm.

3. A plasma display panel according to claim 1, wherein the discharge gas includes 10 or more percent by volume of xenon.

4. A plasma display panel according to claim 1, wherein the phosphor layers include red phosphor layers, green phosphor layers and blue phosphor layers, and the blue phosphor layers include BAM blue phosphor materials.

5. A plasma display panel according to claim 1, wherein the magnesium oxide crystals are single crystals produced by performing vapor-phase oxidation on steam generated by heating magnesium.

6. A plasma display panel according to claim 1, wherein the magnesium oxide crystals include single crystals having a particle diameter of 2000 angstroms or more.

7. A plasma display panel according to claim 1, wherein the magnesium oxide layer including the magnesium oxide crystals is formed on a dielectric layer covering the row electrode pairs.

8. A plasma display panel according to claim 1, wherein the magnesium oxide layer including the magnesium oxide crystals is formed on another magnesium oxide layer that is formed on a dielectric layer covering the row electrode pairs by vapor deposition.

9. A plasma display panel according to claim 1, wherein said magnesium oxide crystals emit ultraviolet light with a peak wavelength of 230 nm to 250 nm when excited by an ultraviolet light emitted by the discharge gas.

10. The plasma display according to claim 1, wherein the plurality of row electrode pairs and the magnesium oxide layer are disposed at the front substrate side, and the plurality of column electrodes are disposed at the back substrate side.

11. The plasma display according to claim 1, wherein a discharge delay time is smaller than 1 μs.

* * * * *